US007065221B1

(12) United States Patent
Tanaka

(10) Patent No.: US 7,065,221 B1
(45) Date of Patent: Jun. 20, 2006

(54) SPEAKER APPARATUS

(75) Inventor: Hidekazu Tanaka, Matsusaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/601,241

(22) PCT Filed: Nov. 29, 1999

(86) PCT No.: PCT/JP99/06645

§ 371 (c)(1),
(2), (4) Date: Jan. 17, 2002

(87) PCT Pub. No.: WO00/33610

PCT Pub. Date: Jun. 8, 2000

(30) Foreign Application Priority Data

Dec. 1, 1998 (JP) ..... 10/341233

(51) Int. Cl.
*H04R 3/00* (2006.01)

(52) U.S. Cl. ..... 381/96; 381/59

(58) Field of Classification Search ..... 381/95, 381/96, 91, 94.1, 122, 120, 121, 56, 58, 59
See application file for complete search history.

(56) References Cited

U.S. PATENT DOCUMENTS 5,596,311 A 1/1997 Bess et al.

FOREIGN PATENT DOCUMENTS

| | | |
|---|---|---|
| EP | 0 658 064 A2 | 6/1995 |
| JP | 7-162990 | 6/1995 |
| JP | 9-205695 | 8/1997 |

*Primary Examiner*—Ping Lee
(74) *Attorney, Agent, or Firm*—Wenderoth, Lind & Ponack, L.L.P.

(57) ABSTRACT

A speaker apparatus in which a reproduced sound from a speaker unit is detected by a microphone and the reproduced sound from the speaker unit is corrected based on the detected signal. The speaker apparatus includes the speaker unit for reproducing an output signal from an amplifier, the microphone for detecting an acoustic output from the speaker unit, and a feedback circuit for feeding the detected acoustic output signal back to the input side of the amplifier. By placing the microphone near a position where sound pressure of at least one of a second and higher pipe resonance of an acoustic pipe is at minimum, an influence of the second and higher pipe resonance is reduced. As the influence of the second and higher pipe resonance is removed from the feedback circuit, stability of the feedback circuit is improved, and therefore, an acoustic characteristic of the speaker apparatus is improved.

6 Claims, 7 Drawing Sheets

SPEAKER APPARATUS

BACKGROUND OF THE INVENTION

1. Field of the Invention

The present invention relates to a speaker apparatus used for a television receiver (TV), and more particularly to a speaker apparatus that comprises a microphone for detecting a reproduced sound from a speaker unit and corrects the reproduced sound based on the detected signal.

2. Description of the Related Art

It is known that a speaker apparatus having the following structure contributes to the improvement of acoustic characteristics. A horn or an acoustic pipe whose opening is rectangular is mounted in front of a speaker unit, and a sound wave generated in the speaker unit is guided to the opening of the acoustic pipe. A microphone is mounted in this acoustic pipe and is connected to an amplifier for inputting an input signal into the speaker unit through a feedback circuit.

The prior art discussed above is shown in FIG. 8 and FIG. 9. FIG. 8 is a horizontal sectional view of a conventional acoustic pipe type speaker apparatus with a sound feedback system, and FIG. 9 shows acoustic output characteristics thereof.

In FIG. 8, a speaker unit 1 produces sound wave and is connected with an acoustic pipe 2. Sound absorbing material 3 is disposed for damping resonance on both sides of the acoustic pipe 2. In the acoustic pipe 2, a microphone 4 for detecting an acoustic output signal is placed near the speaker unit 1. When a signal is fed into the speaker unit 1, the speaker unit 1 radiates an acoustic output, and the acoustic output is lead through the acoustic pipe 2 and radiated out from the opening of acoustic pipe 2.

At this time, for preventing a speaker apparatus from having a reproduced-sound-pressure frequency characteristic with radical peaks and dips caused by a standing wave occurring inside the acoustic pipe 2 or a standing wave due to the length of acoustic pipe 2, such standing waves must be damped by the sound absorbing material 3. However, this countermeasure is insufficient, and therefore, microphone 4 detects the acoustic output, i.e. the unrestrainable standing waves, and feeds them back to an amplifier that input a signal into the speaker unit 1. The standing waves occurring in the acoustic pipe 2 are thus damped so that a flat reproduced sound pressure frequency characteristic is obtained.

Frequency characteristics of the speaker unit 1 and the acoustic pipe 2 can be corrected by placing the microphone 4 in front of and close to the speaker unit 1. The characteristic of the acoustic pipe 2 can be corrected by placing the microphone 4 at a position where the sound pressure of a primary resonance of the acoustic pipe 2 is maximum, i.e. at a position of one third of the length of the acoustic pipe 2. The characteristic can be controlled from a low frequency region to the primary resonance region of the acoustic pipe 2 by placing the microphone 4 near the terminal of acoustic pipe 2.

The conventional speaker apparatus discussed above hardly keeps a sufficient oscillation margin, because the microphone 4 detects acoustic outputs of second and higher resonance generated in the acoustic pipe 2, and the microphone 4 also detects a resonance occurring in a closed space which is orthogonal to the longitudinal direction of the acoustic pipe 2, and feeds them back to the amplifier. In addition, the shape of the acoustic pipe 2 becomes complicated for damping the standing wave, and the speaker apparatus becomes expensive due to the use of sound absorbing material 3 or the like.

The present invention aims to address these problems, and provides a speaker apparatus that has a simply structured acoustic pipe and has a stable acoustic characteristic.

SUMMARY OF THE INVENTION

For addressing the problems discussed above, a speaker apparatus of the present invention comprises the following elements:

an amplifier for receiving an input signal;

a speaker unit for reproducing an output of the amplifier;

a microphone for detecting an acoustic output radiated from the speaker unit; and a feedback circuit for feeding the acoustic output signal that is detected by the microphone back to the input side of the amplifier;

wherein an acoustic pipe for guiding a sound wave is placed in front of the speaker unit. In addition, the microphone for correcting the primary resonance is placed at a position where sound pressure of at least one of a second and higher resonance of this acoustic pipe is low enough to prevent oscillation. The speaker apparatus can thus obtain a stable characteristic by restraining the influence of the primary resonance that is the largest factor to a sound pressure frequency characteristic of the speaker apparatus employing the acoustic pipe.

DESCRIPTION OF THE PREFERRED EMBODIMENTS

Figure 1:
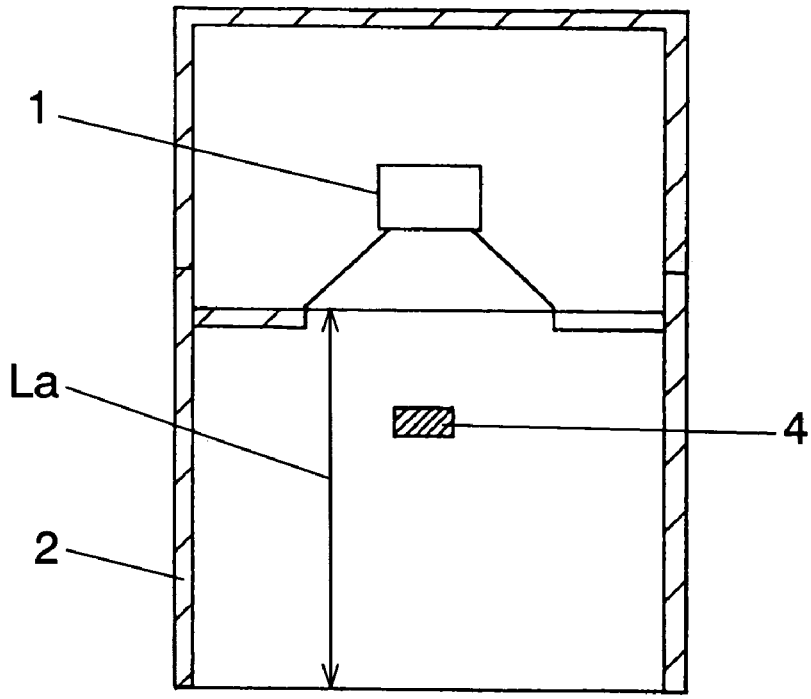
FIG. 1 is a horizontal sectional view of a speaker apparatus in accordance with a first embodiment of the present invention.

Embodiments of the present invention are described hereinafter with reference to FIGS. 1–7.

In the following explanation, the same elements used in the description of the prior art are denoted with the same reference numerals.

First Embodiment

A first embodiment of the present invention is described with reference to FIGS. 1–3.

FIG. 1 is a horizontal sectional view showing a configuration of a speaker unit 1 combined with an acoustic pipe 2. The acoustic pipe 2 is an important element of the speaker apparatus and is used for guiding a sound wave. FIG. 2 is a block diagram of an acoustic circuit using the speaker apparatus, and FIG. 3 is an acoustic output characteristic of the speaker apparatus.

First, an entire configuration of the speaker apparatus is described with reference to FIG. 2.

Figure 2:
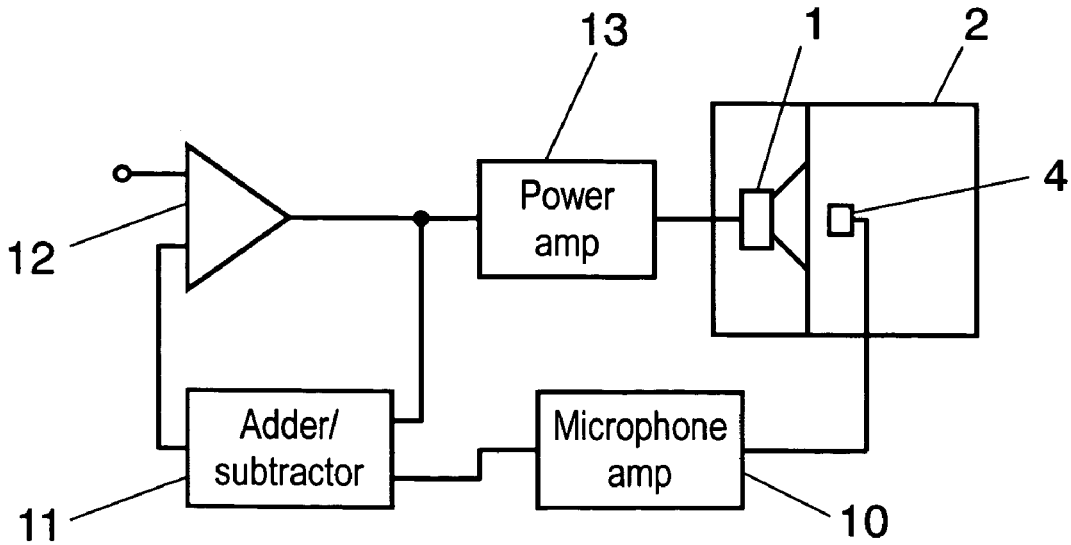
FIG. 2 is a block diagram of the same speaker apparatus of FIG. 1.

In FIG. 2, the speaker unit 1 is coupled to the acoustic pipe 2 in the front of the speaker unit 1, and a microphone 4 is mounted inside the acoustic pipe 2. A sound wave which is radiated from the speaker unit 1 is detected by the microphone 4 in the acoustic pipe 2 and a signal travels through a microphone amplifier 10 and an adder/subtracter 11. This signal is mixed with an external input signal in a subtracter 12 so as to correct the input signal. The signal is then amplified by a power amplifier 13 and is input into the speaker unit 1.

As discussed above, the speaker apparatus undergoes a frequency correction of an acoustic output signal using the sound wave radiated from the speaker unit 1 with a feedback circuit. Next, a position of the microphone 4 in the acoustic pipe 2, which is an important element, is described, and a means for correcting the primary resonance, which is a primary essence of the invention, is described.

A positional relation between the speaker unit 1 and the acoustic pipe 2 will now be described. The acoustic pipe 2, which guides the sound wave, is placed in the front of the speaker unit 1 mounted to a speaker box (not shown). Sound is radiated from an opening shaped in a narrow rectangular slit. The microphone 4 is placed near a position (node position) where sound pressures of a second and third pipe resonance occurring in the acoustic pipe 2 are at a minimum. This position is a common position that is not subjected to the pipe resonance and is near to the positions where the respective sound pressures of the second and third resonance are at a minimum, because the sound pressures of the second and third resonance are generally at a minimum at different positions. The frequencies of the second and third resonance occur responsive to the length "La", which is a distance from the opening of speaker unit 1 to the opening of the acoustic pipe 2, and are calculated using the following equation:

$$fa=(n+1)C/4\ La$$

where "fa" is the pipe resonance frequency, "n" is 2 for a second resonance and 3 for a third resonance, "C" is the sound velocity, and La is the acoustic pipe length.

The microphone 4 detects only a primary component of the pipe resonance from the acoustic output signal radiated from speaker unit 1 combined with acoustic pipe 2, and feeds the detected acoustic output signal back to subtracter 12.

FIG. 2 is the block diagram of the speaker apparatus, and a relation between the input and output voltages satisfies the following equation:

$$Vout/Vin=A/(1+A\cdot T(S))$$

where Vout is an output voltage, Vin is an input voltage, A is the total amplification factor of the amplifier, and T(S) is a transfer function.

Assuming T(S) is substantially a transfer function of the speaker unit 1 because a characteristic of the microphone 4 is almost flat, T(S) becomes "−1" due to a phase shift of the second and third pipe resonance of the speaker unit 1 and the acoustic pipe 2.

In other words, the denominator becomes null (0) to provide a condition of oscillation.

But, in the present invention, the microphone 4 does not detect the second and third pipe resonance occurring in acoustic pipe 2, and thus T(A) hardly takes "−1", which allows for the stable feedback control.

Figure 3:
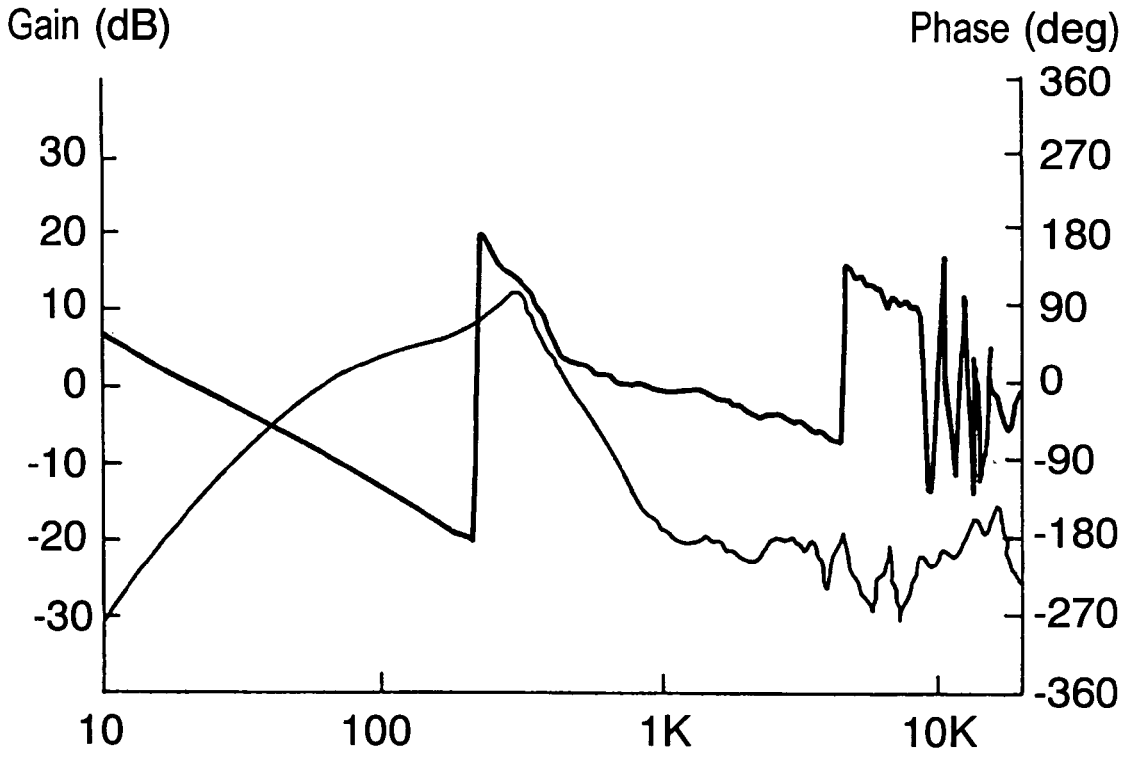
FIG. 3 is an acoustic output characteristic diagram of the speaker apparatus of FIG. 1.
Figure 9:
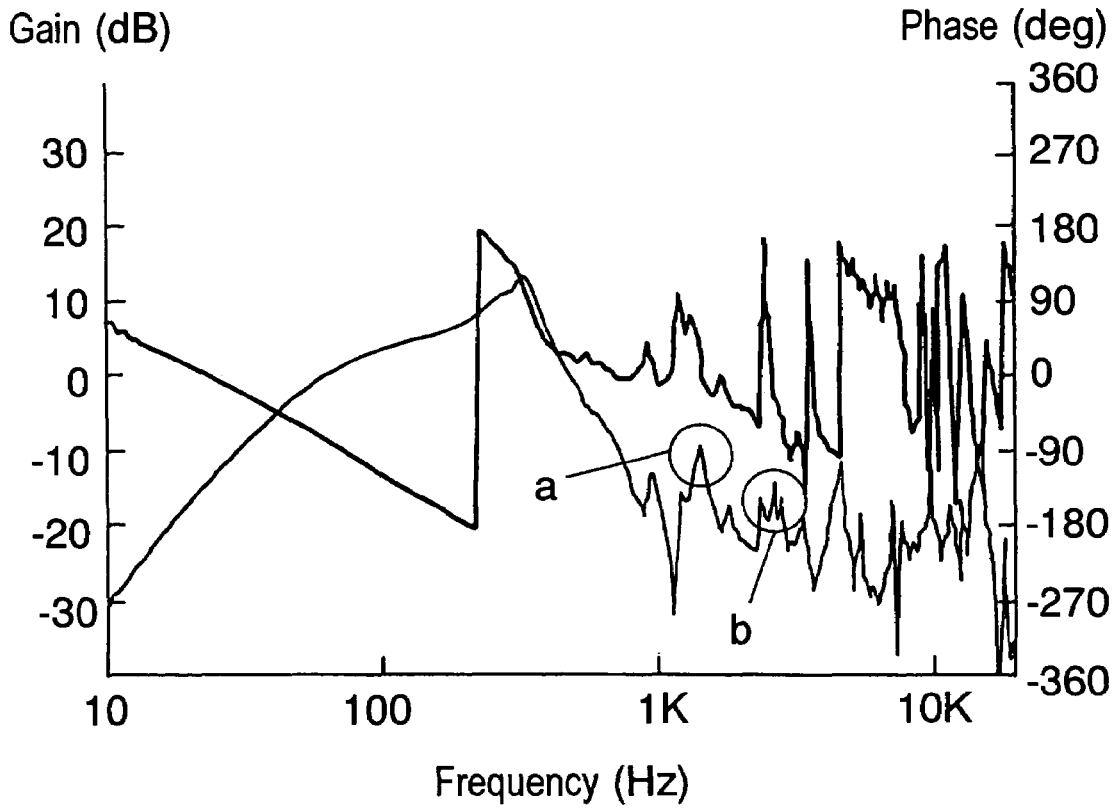
FIG. 9 is an acoustic output characteristic diagram of the conventional speaker apparatus.

FIG. 3 shows the acoustic output characteristic of the speaker apparatus according to the first embodiment. The prior art acoustic output characteristic shown in FIG. 9 includes the second and third pipe resonance ((a) and (b) portions in FIG. 9), but the acoustic output characteristic shown in FIG. 3 does not include the second and third pipe resonance.

Thus, the acoustic output characteristic can be improved by detecting only the primary resonance of pipe resonance occurring in the acoustic pipe 2 with the microphone 4 and by feeding it back. Depending on a required acoustic output characteristic, the acoustic pipe 2 can be constituted without using a sound absorbing chamber or sound absorbing material that employs Helmholtz resonance and is used for damping resonance in a conventional acoustic pipe. As a result, the efficiency of a design of the acoustic pipe 2 is improved, and a greatly economical speaker apparatus can be provided because a die structure or the like is simple.

In the first embodiment, the microphone 4 is placed at the position which is not affected by the second and third pipe resonance. But, if the influence of either of the second or third pipe resonance can be neglected in relation to the acoustic output characteristic, the microphone 4 may be placed only near a position (sound pressure does not cause pipe resonance) where the sound pressure of either of the second or third pipe resonance frequency is at a minimum.

The microphone 4 may be placed at a position where the second and higher pipe resonance can be neglected in the characteristic of the employed acoustic pipe 2.

Second Embodiment

A second embodiment of the present invention is described with reference to FIG. 4A and FIG. 4B.

Figure 4A:
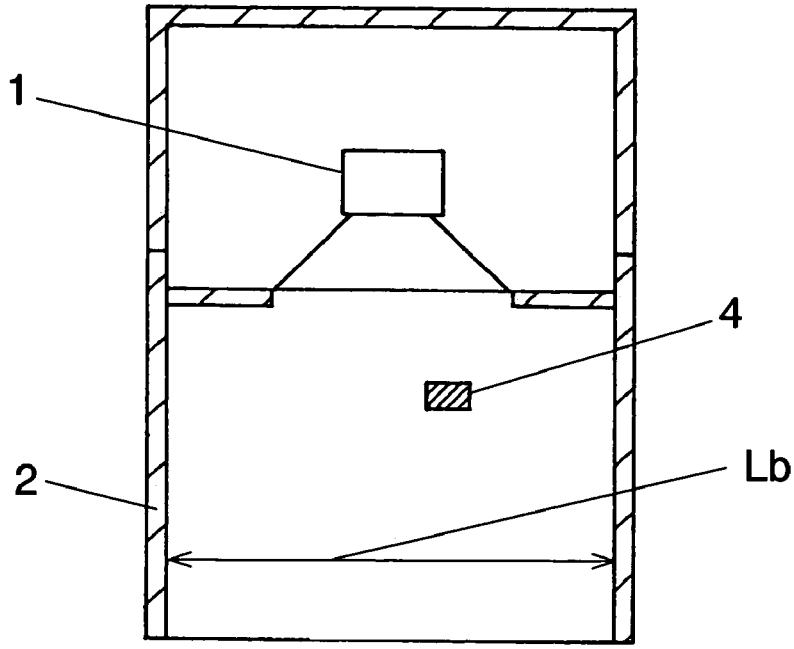
FIG. 4A is a horizontal sectional view of a speaker apparatus in accordance with a second embodiment of the present invention.
Figure 4B:
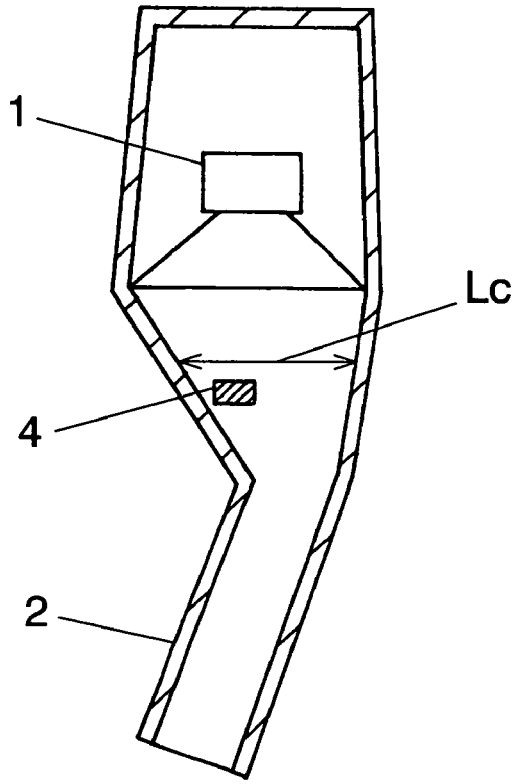
FIG. 4B is a vertical sectional view of the speaker apparatus of FIG. 4A.

FIG. 4A is a horizontal sectional view showing a configuration of the speaker unit 1 combined with the acoustic pipe 2, which is an important element and which is used for guiding a sound wave. FIG. 4B is a vertical sectional view of the speaker apparatus according to the second embodiment. Only a different between the first and second embodiments is described with reference to FIG. 4B. Resonance frequencies fb and fc occurring in a closed space that is orthogonal to the longitudinal direction of acoustic pipe 2 are calculated using the following equations:

$$fb=(n+1)C/2\ Lb,\ \text{and}\ fc=(n+1)C/2\ Lc,$$

where, fb is pipe resonance frequency orthogonal to the longitudinal direction of the acoustic pipe (the latitudinal direction of the acoustic pipe), fc is pipe resonance frequency resonating orthogonal to the longitudinal direction of the acoustic pipe and also orthogonal to the resonance direction of fb, n is 2 for a second resonance and 3 for a third resonance, C is the sound velocity, Lb is the length of the acoustic pipe that is orthogonal to the longitudinal direction of the acoustic pipe (the latitudinal direction of the acoustic pipe), and Lc is length of the acoustic pipe that is orthogonal to the direction Lb. The microphone 4 is placed near a position (node position) where the sound pressures of the resonance frequencies fb and fc occurring in the closed space that is orthogonal to the longitudinal direction of the acoustic pipe 2 are respectively at a minimum. This position is a common position that is not subjected to the pipe resonance and is near to the positions where the respective sound pressures of the respective frequencies are at a minimum, because the sound pressures of the two-direction resonance are generally at a minimum at different positions. The microphone 4 is prevented from detecting the resonance frequency components occurring in the closed space that is orthogonal to the longitudinal direction of the acoustic pipe 2 in the acoustic output signal radiated from the speaker unit 1 combined with acoustic pipe 2, and feedback is performed using the acoustic output signal from the microphone 4.

Since resonance occurring in the closed space that is orthogonal to the longitudinal direction of the acoustic pipe 2 are not detected by the microphone 4 in the present invention, T(S) hardly takes "−1", which allows for the stable feedback control. Thus, the resonance frequencies occurring in the closed space in acoustic pipe 2 are not detected, and as a result, the stability of the feedback can be secured.

Third Embodiment

A third embodiment of the present invention is described with reference to FIG. 5A and FIG. 5B.

Figure 5A:
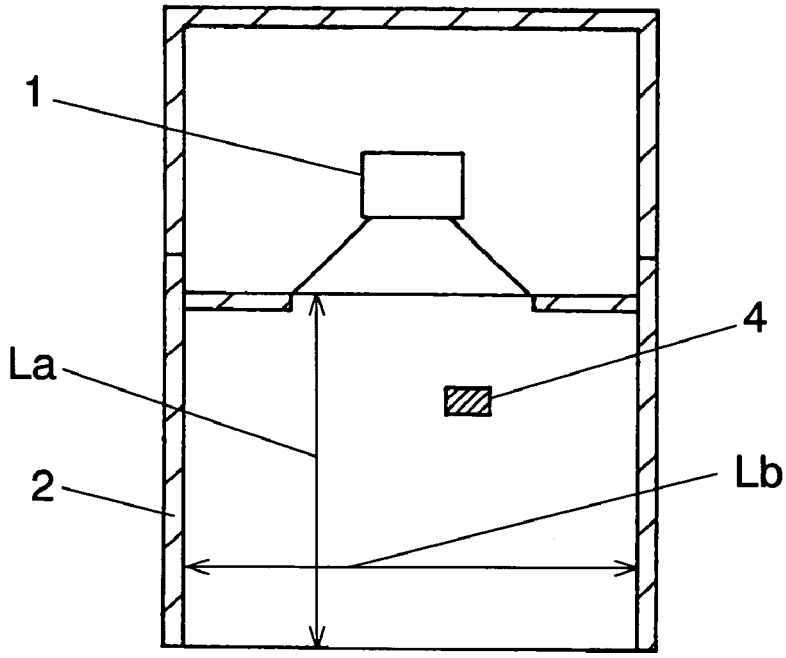
FIG. 5A is a horizontal sectional view of a speaker apparatus in accordance with a third embodiment of the present invention.
Figure 5B:
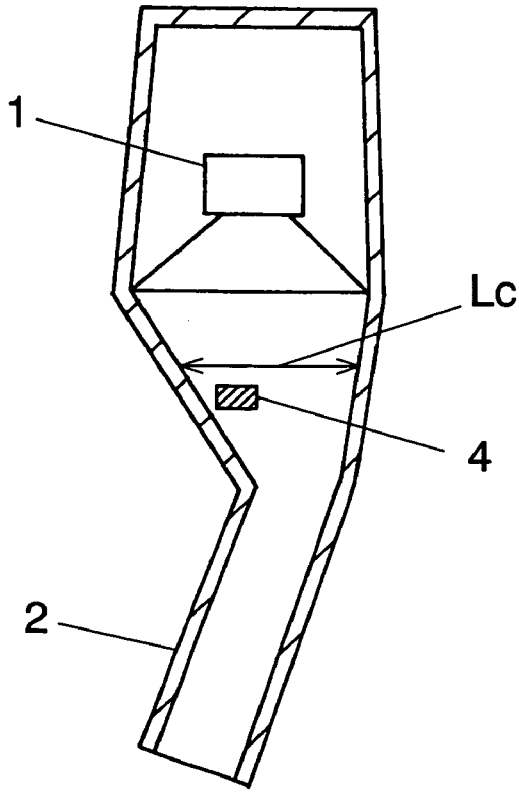
FIG. 5B is a vertical sectional view of the speaker apparatus of FIG. 5A.

FIG. 5A is a horizontal sectional view showing a configuration of the speaker unit 1 combined with acoustic pipe 2, which is an important element and which is used for guiding a sound wave. FIG. 5B is a vertical sectional view of the third embodiment. The third embodiment has both features of the first and the second embodiments. The microphone 4 is placed at a position where it is not affected by the second and third pipe resonance depending on the length of the acoustic pipe 2 and, in addition, the microphone 4 is also not affected by a resonance orthogonal to the longitudinal direction (a resonance of the latitudinal direction) of acoustic pipe 2. The microphone 4 detects only the primary resonance of the acoustic pipe 2 and does not detect a resonance frequency occurring in the closed space that is orthogonal to the longitudinal direction of the acoustic pipe 2. This position, where the microphone 4 is disposed, is not subjected to the pipe resonance and yet is close to the positions (node positions) where the sound pressures of the respective resonance frequencies are at a minimum. Thus, the stability of the feedback can be secured.

Fourth Embodiment

A fourth embodiment of the present invention is described with reference to FIG. 6 and FIG. 7.

Figure 6:
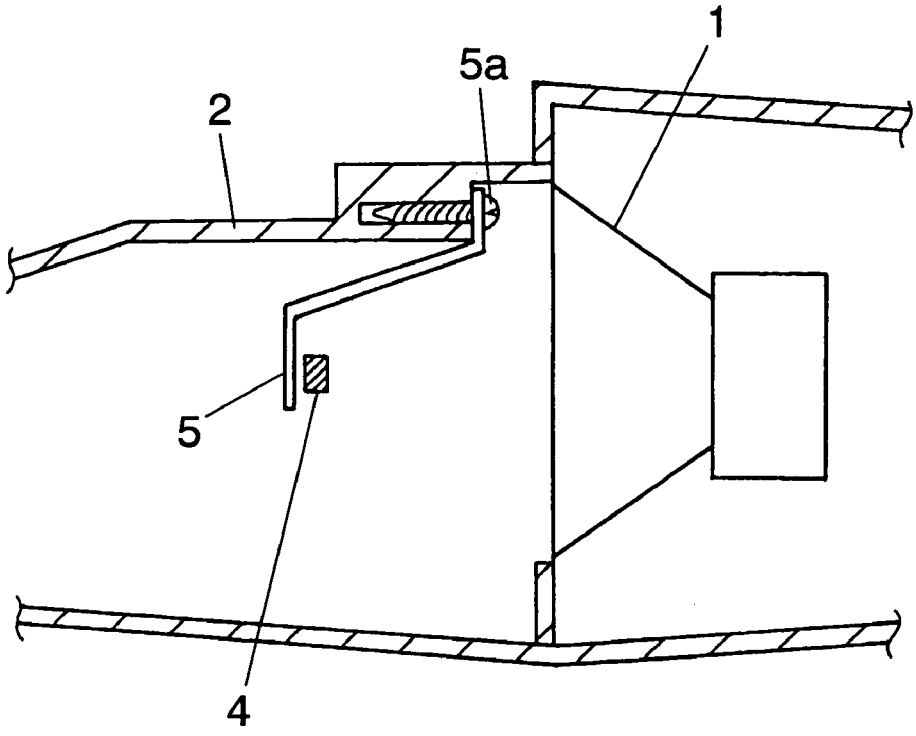
FIG. 6 is a vertical sectional view illustrating a mounting means of a microphone in an acoustic pipe, which is an important element of a fourth embodiment of the present invention.
Figure 7:
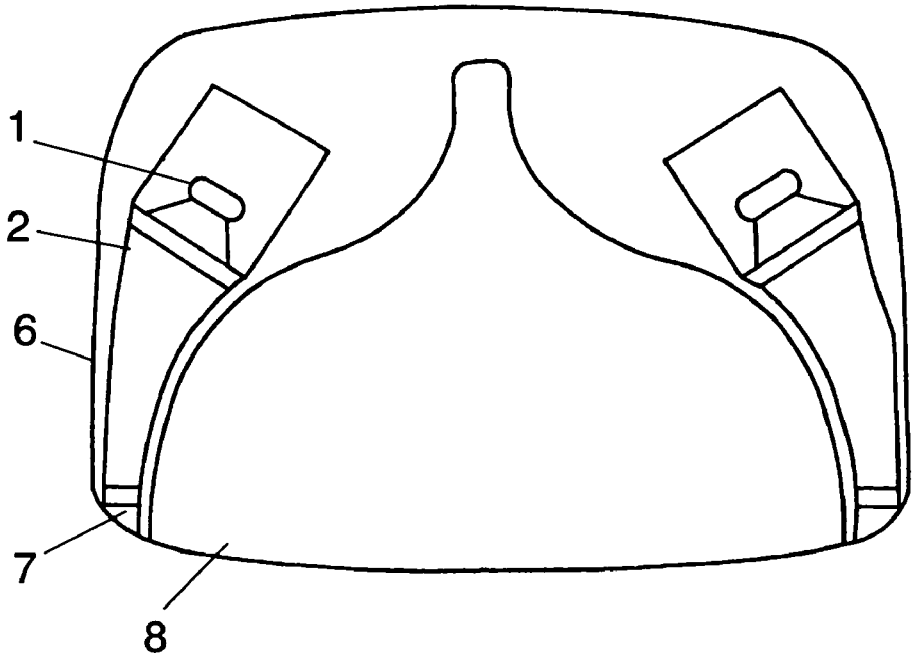
FIG. 7 is a schematic diagram illustrating a speaker apparatus disposed in a TV receiver according to the fourth embodiment.
Figure 8:
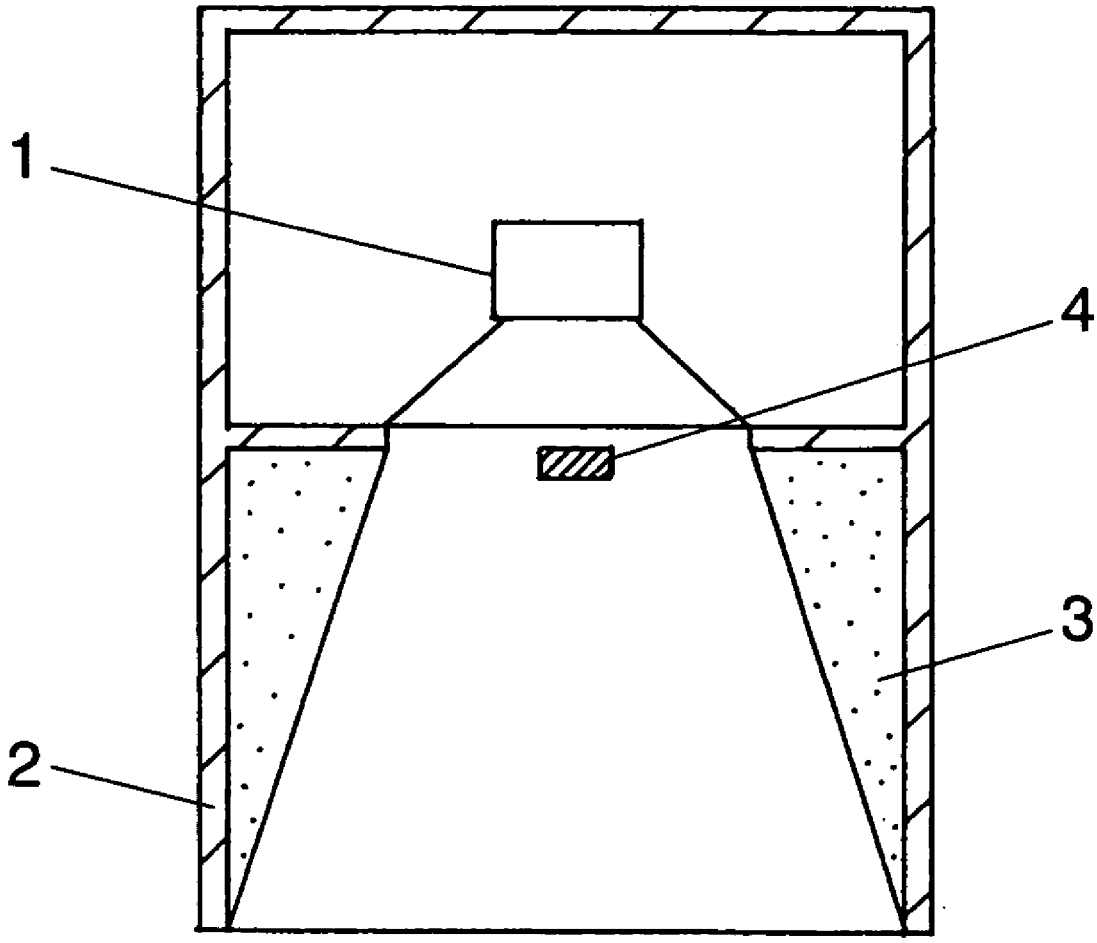
FIG. 8 is a horizontal sectional view of a conventional speaker apparatus.

FIG. 6 is a sectional view of the fourth embodiment near the acoustic pipe 2, and FIG. 7 is a sectional view when the speaker apparatus is mounted to a TV receiver. The fourth embodiment shows a mounting means for the microphone 4 more specifically than those in each of the embodiments discussed above. Bracket 5 is mounted to a wall of the acoustic pipe 2 via a fastening means 5*a*, and the bracket 5 can set the microphone 4 with ease in each of the respective first through third embodiments at a given position.

The speaker apparatus is constituted so that it is mounted to the TV and is placed between a cathode ray tube 8 (CRT) and a television cabinet 6. Even if the length of a sound guiding portion 7 of television cabinet 6 is changed, which would cause the length of the acoustic pipe of the speaker apparatus to be modified, which would in turn cause the condition of the resonance frequency to change, the position of the microphone 4 can be easily shifted by replacing the bracket 5 with an appropriate one. In other words, the stability of the feedback circuit can be improved by shifting the setting position of microphone 4 to the position described in the first through third embodiments.

The present invention is still applicable even when a rib or the like is formed in the acoustic pipe 2 for reinforcement, which would thus cause the resonance system to be increased in the acoustic pipe 2.

INDUSTRIAL APPLICABILITY

First, a speaker apparatus of the present invention comprises the following elements:

an amplifier for receiving an input signal;

a speaker unit for reproducing an output signal supplied from the amplifier;

a microphone for detecting an acoustic output radiated from the speaker unit; and a feedback circuit for feeding the acoustic output signal detected by the microphone back to the input side of the amplifier.

In addition, the speaker apparatus is constituted so that an acoustic pipe for guiding a sound wave is mounted in the front of the speaker unit and the microphone is placed at a position where a sound pressure of at least one of a second and higher pipe resonance of the acoustic pipe is low enough not to cause oscillation. Thus, an influence of the second and higher pipe resonance is reduced to improve stability of the feedback circuit and to allow an increase in the feedback amount, and therefore, a speaker apparatus with an excellent acoustic characteristic is obtainable.

Second, in the configuration discussed above, when the microphone is placed at a position where the sound pressure of at least one of a second and third pipe resonance is low enough not to cause oscillation, an influence of at least one of the influential second and third pipe resonance is reduced and a speaker apparatus with a more excellent acoustic characteristic is obtainable.

Third, a speaker apparatus comprises the following elements:

an amplifier for receiving an input signal;

a speaker unit for reproducing an output signal supplied from the amplifier;

a microphone for detecting an acoustic output emitted from the speaker unit; and a feedback circuit for feeding the acoustic output signal detected by the microphone back to the input side of the amplifier.

In addition, the speaker apparatus is constituted so that an acoustic pipe for guiding a sound wave is mounted in the front of the speaker unit and the microphone is placed at a position where at least the sound pressure of a resonance occurring in a closed space of this acoustic pipe is low enough not to cause oscillation. Thus, the stability of the feedback circuit can be improved even in the closed space, a feedback amount can be increased, and therefore, a speaker apparatus with an excellent acoustic characteristic is obtainable.

Fourth, a speaker apparatus comprises the following elements:

an amplifier for receiving an input signal;

a speaker unit for reproducing an output signal supplied from the amplifier;

a microphone for detecting an acoustic output radiated from the speaker unit; and a feedback circuit for feeding the acoustic output signal detected by the microphone back to the input side of the amplifier.

In addition, the speaker apparatus is constituted so that an acoustic pipe for guiding a sound wave is mounted in the front of the speaker unit and the microphone is placed at the following position: the sound pressure of at least one of a second and third pipe resonance of this acoustic pipe is low enough not to cause oscillation; and at least the sound pressure of a resonance occurring in the closed space of this acoustic pipe is low enough to prevent oscillation. Thus, influences of at least one of the second and third pipe resonance in the longitudinal direction of the acoustic pipe and influences of resonance occurring in the closed space of the acoustic pipe are both reduced, and therefore, a speaker apparatus with an excellent acoustic characteristic is obtainable.

The invention claimed is:

1. A speaker apparatus comprising:

an amplifier operable to receive an input signal and to output an amplified signal;

a speaker unit operable to reproduce the amplified signal and to radiate an acoustic output signal;

an acoustic pipe mounted in front of said speaker unit;

a microphone disposed in said acoustic pipe, said microphone being operable to detect the acoustic output signal radiated from said speaker unit; and a feedback circuit operable to feed the acoustic output signal detected by said microphone back to an input side of said amplifier;

wherein said microphone is placed at a position where sound pressure of resonance occurring in a longitudinal direction, in a latitudinal direction orthogonal to the longitudinal direction, and in a direction orthogonal to both the longitudinal direction and the latitudinal direction of the acoustic pipe is low enough so as not to cause oscillation; and wherein said microphone is placed at a position where sound pressure of a second and third pipe resonance in the longitudinal direction, in the latitudinal direction and in the direction orthogonal to both the longitudinal direction and the latitudinal direction of the acoustic pipe is low enough so as not to cause oscillation, and where sound pressure of a resonance occurring in a closed space of the acoustic pipe is low enough so as not to cause oscillation.

2. The speaker apparatus according to claim 1, wherein said microphone is mounted at an inner space position in said acoustic pipe via a bracket.

3. The speaker apparatus according to claim 1, wherein said feedback circuit comprises an adder/subtractor and a microphone amplifier.

4. The speaker apparatus according to claim 3, wherein said microphone amplifier is operable to amplify the acoustic output signal detected by said amplifier and to output the acoustic output signal, and said adder/subtractor is operable to receive the acoustic output signal and to feed the acoustic signal back to the input side of the amplifier.

5. The speaker apparatus according to claim 4, further comprising a subtractor operable to correct the input signal received by said amplifier by mixing the acoustic output signal output by said adder/subtractor with an external input signal.

6. The speaker apparatus according to claim 1, further comprising a subtractor operable to correct the input signal received by amplifier by mixing the acoustic output signal with an external input signal.

* * * * *

UNITED STATES PATENT AND TRADEMARK OFFICE

CERTIFICATE OF CORRECTION

PATENT NO. : 7,065,221 B1
APPLICATION NO. : 09/601241
DATED : June 20, 2006
INVENTOR(S) : Hidekazu Tanaka It is certified that error appears in the above-identified patent and that said Letters Patent is hereby corrected as shown below:

IN THE CLAIMS

Claim 1

In column 8, line 12, please add --at least-- after "where" and before "sound".

Signed and Sealed this

Seventeenth Day of October, 2006

JON W. DUDAS
*Director of the United States Patent and Trademark Office*